US007087826B1

(12) United States Patent
Lombardi

(10) Patent No.: US 7,087,826 B1
(45) Date of Patent: Aug. 8, 2006

(54) PERCUSSION INSTRUMENT POSITION ADJUSTMENT

(75) Inventor: Donald G. Lombardi, Westlake Village, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 10/933,443

(22) Filed: Sep. 3, 2004

(51) Int. Cl.
*G10D 13/02* (2006.01)

(52) U.S. Cl. ..... 84/421

(58) Field of Classification Search ..... 84/421; 248/443; D17/99
See application file for complete search history.

(56) References Cited

U.S. PATENT DOCUMENTS 6,096,956 A * 8/2000 Hoshino ..... 84/421
6,384,308 B1 * 5/2002 Hoshino ..... 84/421

* cited by examiner

*Primary Examiner*—Kimberly Lockett
(74) *Attorney, Agent, or Firm*—William W. Haefliger

(57) ABSTRACT

Apparatus for adjusting the position of a percussion instrument, to be played, comprising a stand, a percussion instrument support, supported by the stand, apparatus operatively connected between the stand and the support for adjusting the position of the support in the following modes:

i) about a first axis, ii) about a second axis extending at an angle relative to the first axis, iii) lengthwise relative to the second axis, and position locating structure associated with apparatus, for limiting adjusting at a predetermined support position relative to the stand, corresponding to a desired location of the percussion instrument support.

15 Claims, 6 Drawing Sheets

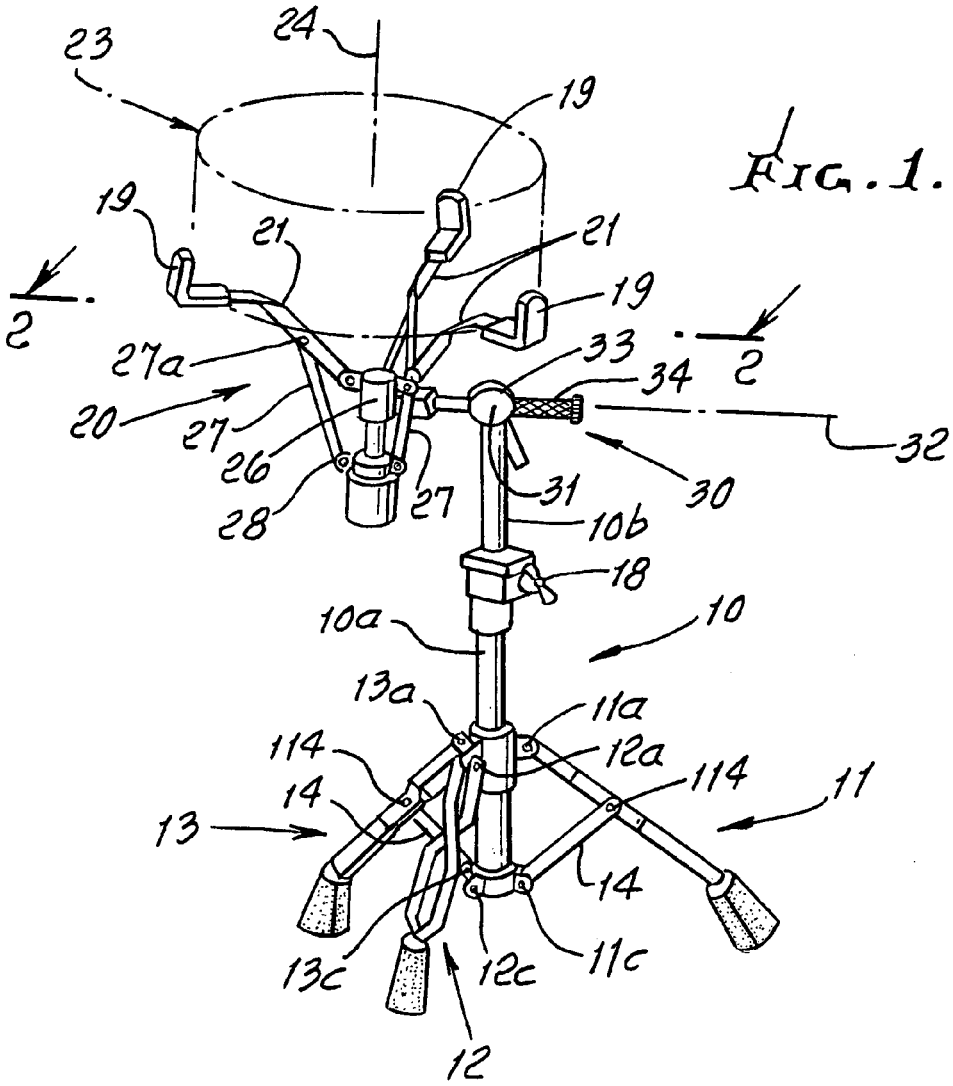
FIG. 1.
FIG. 1a.
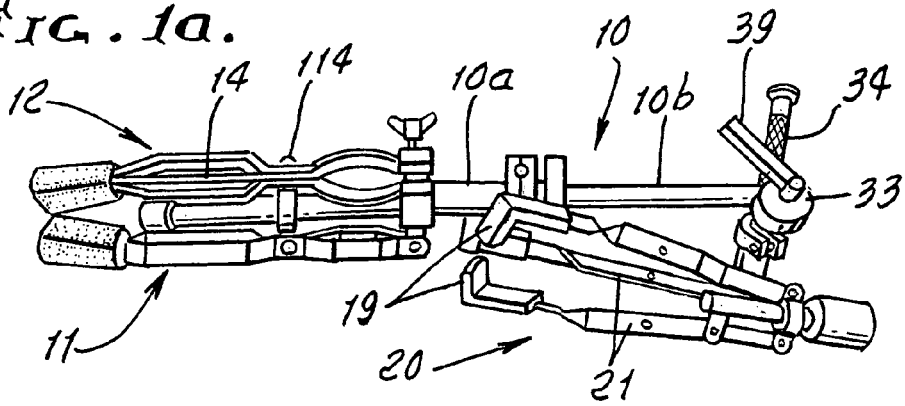

4
4
23
23a
21
21
21
25
25
26
42
40
10b
69
66
31
33
39
34
30
32
19

PERCUSSION INSTRUMENT POSITION ADJUSTMENT

BACKGROUND OF THE INVENTION

This invention relates generally to supporting of percussion instruments during performances, and more particularly to collapsible support apparatus, that can be quickly extended to support a percussion instrument, as for example a drum, during performances.

There is need for such apparatus that can be collapsed for transport, that can quickly be extended when needed, and that is adjustable, for example to change or adjust height of the drum head to suit the drummer, and also to adjust lateral positioning of the drum. There is also need for a way to allow expansion of the apparatus to a pre-set, or pre-adjusted position, so that the drum support need not be adjusted each time the drummer installs his drumming equipment at performance locations.

SUMMARY OF THE INVENTION

It is a major object of the invention to provide improved apparatus meeting the above need, and comprising:

a) a stand, b) a percussion instrument support, supported by the stand, c) means operatively connected between the stand and the support for adjusting the position of the support in the following modes:

i) about a first axis, ii) about a second axis extending at an angle relative to the first axis, iii) lengthwise relative to the second axis, d) and position locating structure associated with said means, for limiting said adjusting at a predetermined support position relative to the stand, corresponding to a desired location of the percussion instrument support.

As will be seen, the position locating structure may typically include:

a) a primary part carried so as to have a fixed position relative to the second axis, b) a secondary part carried so as to be adjustably moved lengthwise relative to the second axis to become blocked by the primary part against rotation about said second axis, and at a position corresponding to desired positioning of the support.

For example, one of the primary and secondary parts may comprise a tongue, and the other part may comprise a groove, pre-adjustment of one such part establishing the preferred positioning of the instrument or drum support, as after extension or expansion of a multi-legged stand.

Another object is to provide a carrier on the stand and defining the first axis, and a shaft or the like defining the second axis, the shaft carried by the carrier for rotation about the first axis and for lengthwise movement relative to the second axis. The carrier may define a bearing for reception of the shaft to allow such shaft rotation and lengthwise movement. In this regard, the primary part may be located on the carrier, and the secondary part on the shaft. Further, the carrier may include $x_1$) a hub defining said first axis, $x_2$) said primary part carried by the hub to be adjustable relative to the hub whereby the preserved positioning of the drum support may be initially established.

An added object is to provide releasable locking structure to lock the shaft in position relative to the carrier. The carrier may also define a swivel operable to allow the shaft to swing into a position generally parallel to the stand, for transport.

These and other objects and advantages of the invention, as well as the details of an illustrative embodiment, will be more fully understood from the following specification and drawings, in which:

DRAWING DESCRIPTION

FIG. 1 is a perspective view of apparatus incorporating a preferred form of the invention, the apparatus expanded or deployed for use;

FIG. 1*a* is a view of the FIG. 1 apparatus in collapsed condition, as for transport;

DETAILED DESCRIPTION

Figure 2:
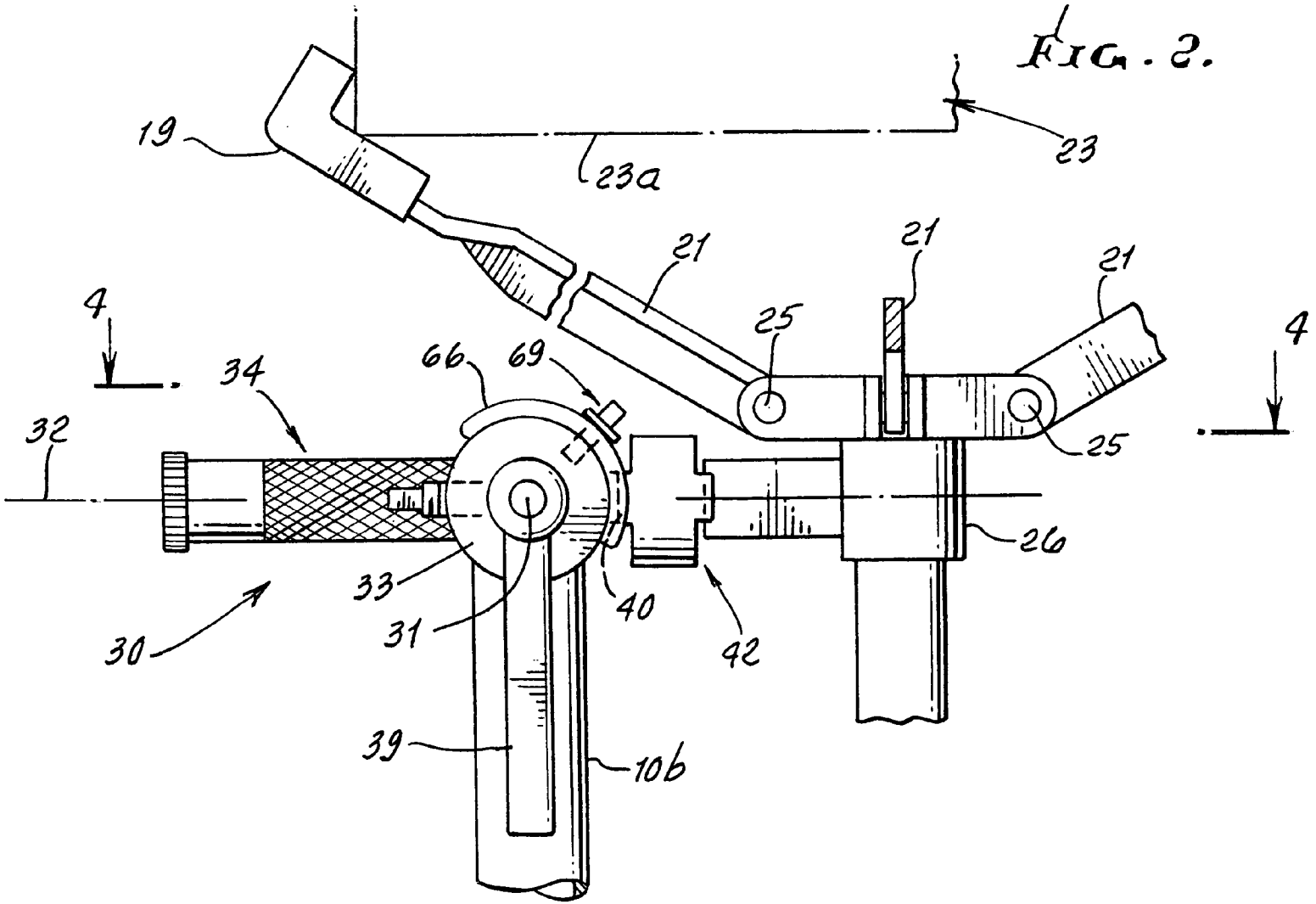
FIG. 2 is an enlarged view taken on lines 2—2 of FIG. 1.

Referring first to FIGS. 1 and 2, a percussion instrument stand 10 extends in upright position, to be supported by legs 11–13. Those legs may be hinge connected to the stand 10, as at hinge locations 11*a*–13*a*, to be folded into generally parallel relation to the stand, as for transport. See FIG. 1*a*. Stabilizing links 14 may be used, and hinge connected to the legs at 114*a*, and to the stand lower extent at 11*c*–13*c*, enabling folding toward the stand. The stand 10 may have telescoping sections 10*a* and 10*b*, with a set screw 18 to be tightened to hold the sections at selected extensions.

A percussion instrument support 20 includes three like legs 21 carrying L-shaped holders 19 which fit a percussion instrument, such as a drum 23 having a shell lower rim 23 *a* received by the holders at locations about an upright axis 24. Legs 21 are hinge connected at 25 to an upright post 26. Stabilizing links 27 are hinge connected at locations 27*a* to the legs, and at locations 28 to a lower portion of the post. L-shaped retainers 19 on the legs, retain the drum at its shell periphery.

Means generally indicated at 30 are operatively connected between the stand 10 and the support 20, for adjusting the position of the support in the following modes:

i) about a first axis, ii) about a second axis extending at an angle relative to the first axis, iii) lengthwise relative to the second axis.

Figure 3:
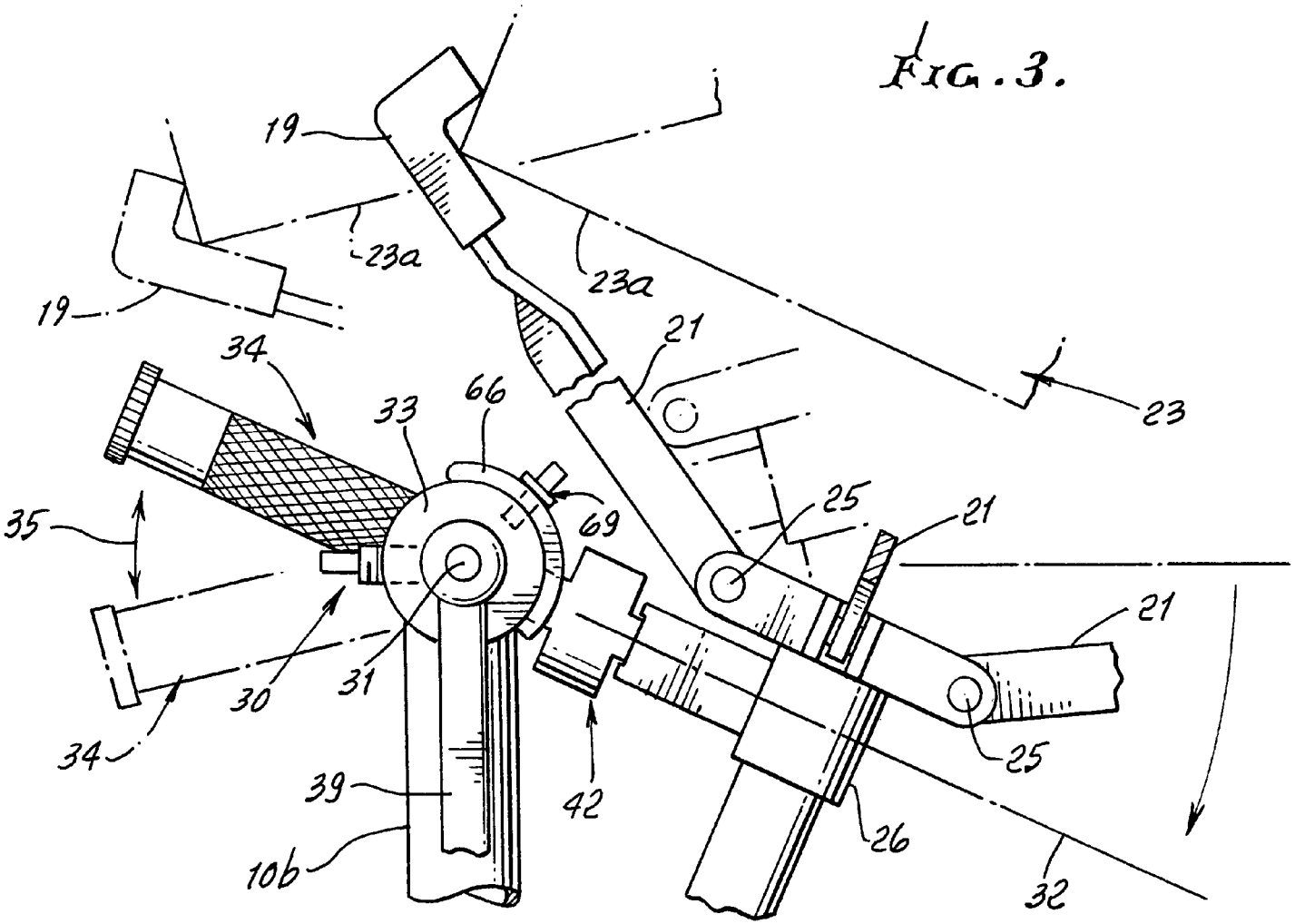
FIG. 3 is a view like FIG. 2, but showing connection means rotatably and adjustably shifted about a first axis.
Figure 4:
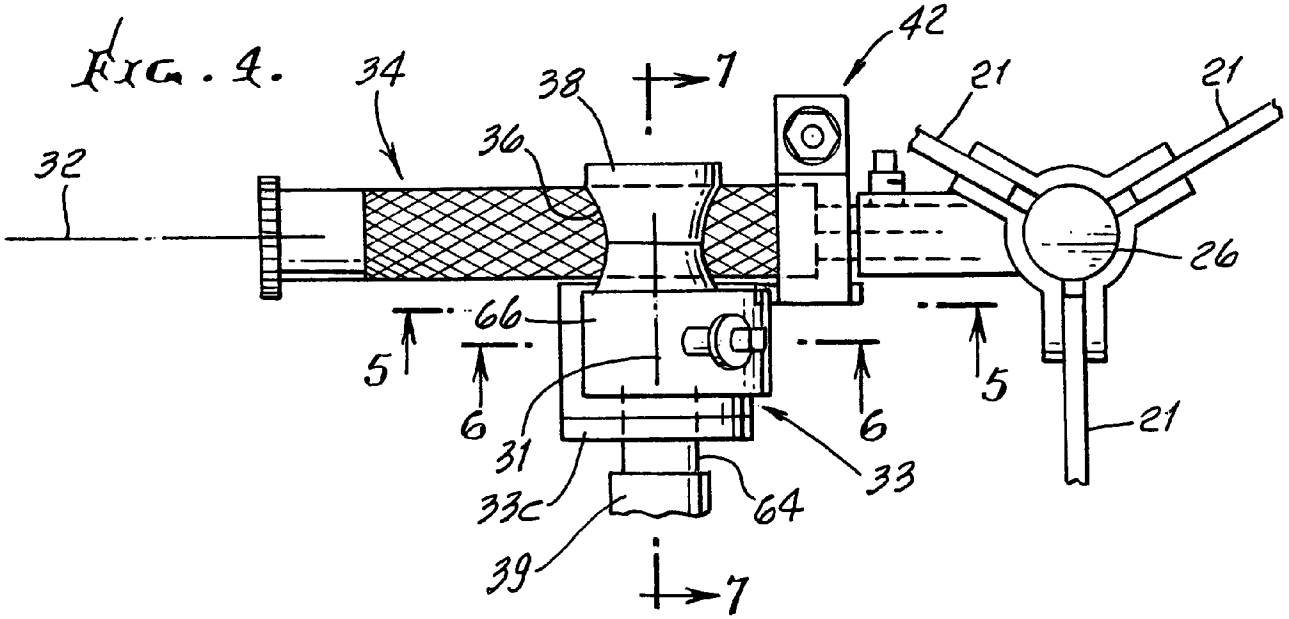
FIG. 4 is an enlarged plan view taken on lines 4—4 of FIG. 2, and showing engaged positions of a positioning tongue and groove.
Figure 5:
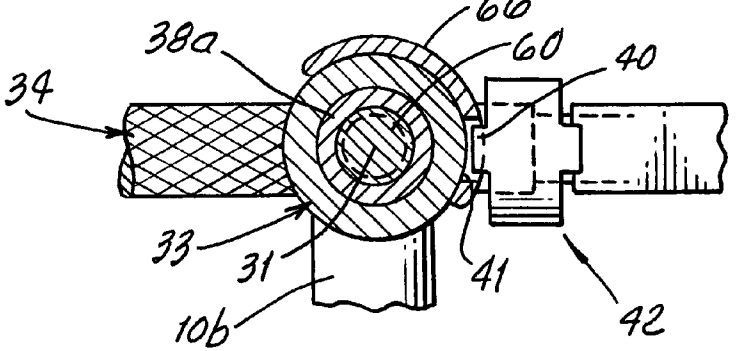
FIG. 5 is a fragmentary section taken on lines 5—5 of FIG. 4.
Figure 7:
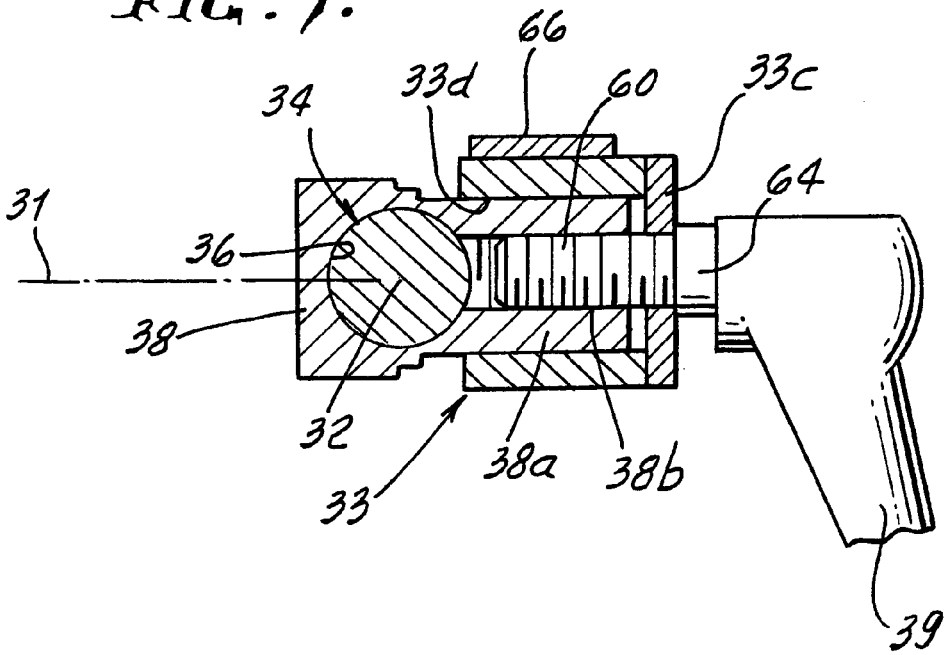
FIG. 7 is a vertical section taken on lines 7—7 of FIG. 4.

In the example, the first and second axes are shown at 31 and 32. First axis 31 is preferably defined by a carrier in the form of a hub 33 mounted on the top of the stand 10. A shaft 34 defines the second axis 32 i.e. the shaft axis, and the shaft is rotatable to limited extent about the first axis 31, as by swiveling, i.e. in arrow directions 35 as seen in FIGS. 2 and 3. Also the shaft 34 is endwise adjustable, along axis 32, as is accommodated by an opening 36 in a shaft holder 38 having a lateral stem 38*a* bearing mounted at 38*b* in the hub 33, to rotate about first axis 31. Tightening of a handle 39 effects clamping of the shaft by the holder 38 acting as a clamp member as seen in FIG. 7, following rotary and axial adjustment of the shaft, at opening 36. Such clamping also blocks rotation of the shaft about first axis 31. Opening 36 defines a bearing, for shaft rotation about second axis 32, and for shaft axial displacement along axis 32.

In accordance with an important aspect of the invention, position locating structure is associated with the above described means 30, for limiting adjustment of the instrument support 20, as for example about and/or along axis 32, and at a predetermined position of the support 20, relative to the stand 10. The intent is to provide easily operated position locating structure, so that the musician can easily and quickly set up his instrument, as during adjustment from collapsed to expanded condition of the stand, and the support and drum (or other instrument) will then always be in a pre-selected position, once the shaft alone is adjusted.

As disclosed herein, the position locating structure includes:

a) a primary part carried so as not be adjustably moved lengthwise relative to the second axis, b) a secondary part carried so as to be adjustably moved lengthwise relative to the second axis to become blocked against rotation about said second axis, and at a position corresponding to desired positioning of the support.

Figure 8:
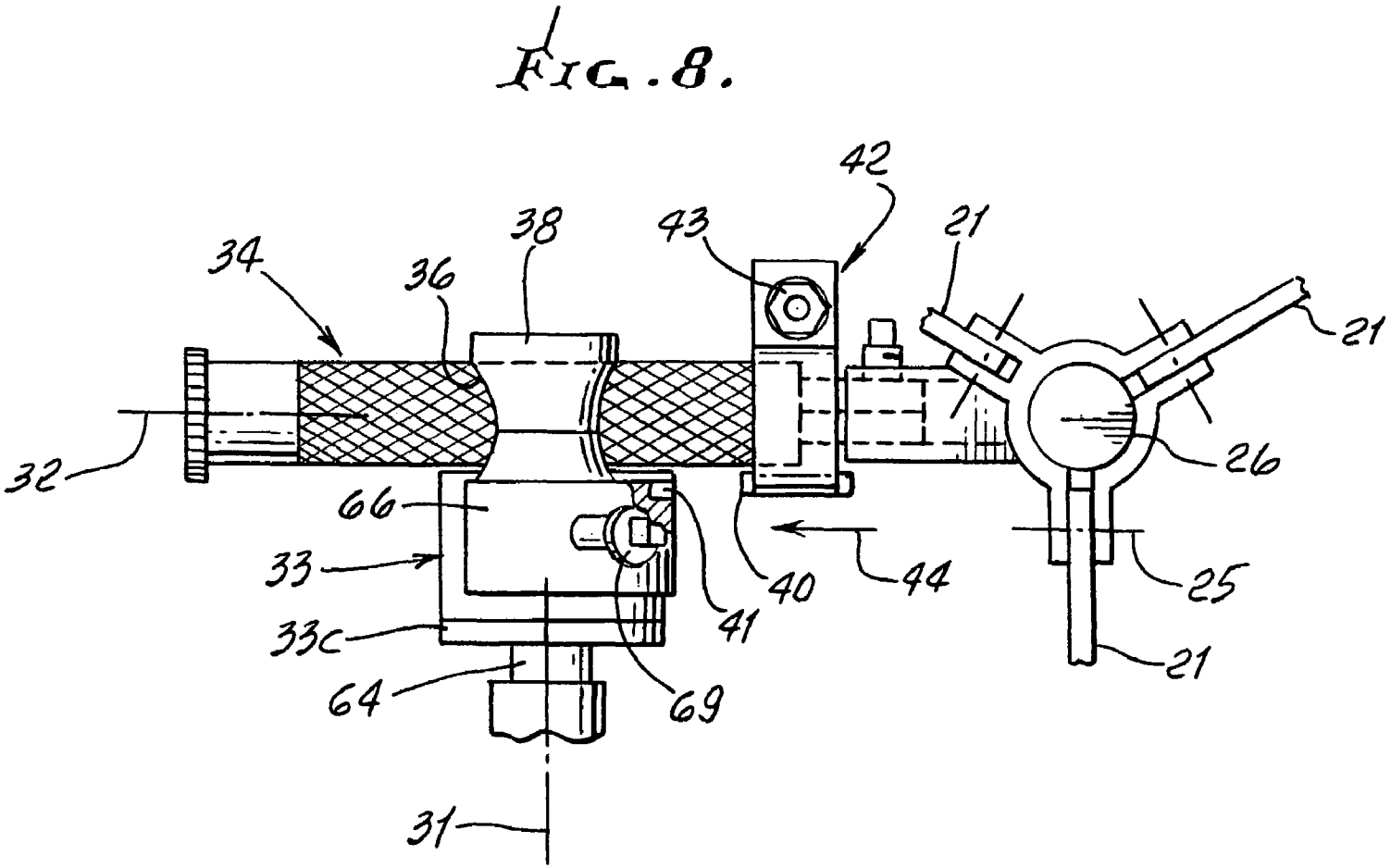
FIG. 8 is a view like FIG. 4, but showing disengaged positions of a positioning tongue and groove.

In the illustrated example, one of the parts is a tongue (as for example is seen in FIG. 8 at 40) and the other of such parts is a groove or notch (as for example is seen at 41). The tongue or projection 40 is shown in FIG. 8 as mounted on the shaft 34, as via an adjustable clamp 42 held in adjusted and fixed position lengthwise on the shaft by a fastener 43; and the groove or notch 41 is shown as formed in or by the hub 33, and facing the tongue 40. The construction is such that as the shaft is displaced axially in direction 44, the tongue will enter the groove if the shaft is at pre-selected and adjusted angularity about or with respect to axis 32, and the shaft will then be blocked against rotation about axis 32 as well as blocked against further axial displacement in direction 44. This tongue and groove interfit position is pre-selected, so that each time the apparatus is set up, the unclamped shaft can be easily positioned to engage the tongue in the groove, and the adjustment handle 39 then tightened, to achieve the desired positioning of the drum support 30, the shaft and hub being locked in position. FIG. 7 shows the handle having a threaded stem 60 engaging a threaded bore 38*b* carried by a tubular stem 38*a* integral with 38. Tubular hub 33 fits over 38*a*, the hub carrying an end plate 33*c*. Handle shaft 64 engages plate 33*c* of stem 60 and pulls 38 and 38*a* to the right, clamping shaft 34, as the handle is tightened. Bore 33*d* receiving 38*a* can be slightly tapered. Such clamp-up prevents adjustment about both axes 31 and 32.

Figure 6:
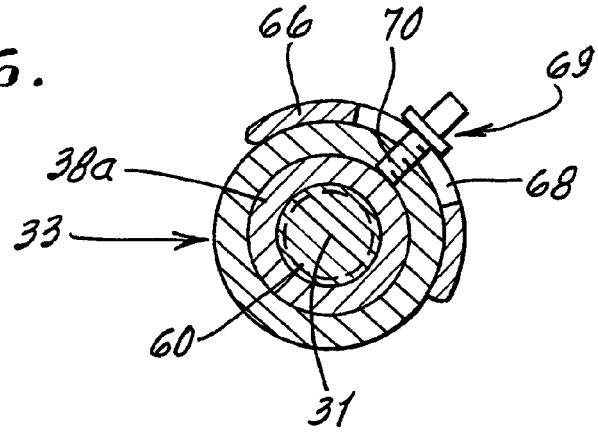
FIG. 6 is a section taken on lines 6—6 of FIG. 4.

Also provided, as seen in FIGS. 6 and 7, is an adjustable holder on the carrier carrying said primary part, and adjustably rotatable about the first axis 31. In the example, the holder is in the form of an arcuate plate 66 fitting about the cylindrical periphery of the hub 33, and defining the groove 41. A slot 68 in the plate 66 receives a clamping screw 69 which is tightened to hold the plate and groove in selected position about the first axis. The screw 69 has threaded engagement with the hub, at 70. This adjustment allows shifting of the plate 66 and selection of angularity of the drum support 30 about the first axis 31, for automatic set-up at selected angles.

I claim:

1. Apparatus for adjusting the position of a percussion instrument, to be played, comprising a) a stand, b) a percussion instrument support, supported by the stand, c) means operatively connected between the stand and the support for adjusting the position of the support in the following modes:

i) about a first axis, ii) about a second axis extending at an angle relative to the first axis, iii) lengthwise relative to the second axis, d) and position locating structure associated with said means, for limiting said adjusting at a predetermined support position relative to the stand, corresponding to a desired location of the percussion instrument support, and including i) a primary part carried so as to have a fixed position relative to the first axis, ii) a secondary part carried so as to be adjustably moved lengthwise relative to the second axis to become blocked by the primary part against rotation about said second axis, and at a position corresponding to desired positioning of the support.

2. The combination of claim 1 including a drum on the support.

3. The combination of claim 1 wherein one of said parts is a tongue, and the other of said parts is a groove.

4. The combination of claim 1 wherein said means includes a carrier on the stand and defining the first axis, and a shaft or the like defining the second axis, the shaft carried by the carrier for rotation about the second axis and for lengthwise movement relative to the second axis.

5. The combination of claim 4 wherein the carrier defines a bearing for reception of the shaft to allow said shaft rotation and lengthwise movement.

6. The combination of claim 1 wherein said means includes a carrier on the stand and defining the first axis, and a shaft or the like defining the second axis, the shaft carried by the carrier for rotation about the first axis and for lengthwise movement along the second axis, and wherein said primary part is on the carrier, and said secondary part is on the shaft.

7. The combination of claim 4 including releasable locking structure to lock the shaft in position relative to the carrier.

8. The combination of claim 6 including releasable locking structure to lock the shaft in position relative to the carrier.

9. The combination of claim 6 wherein the carrier includes:

$x_1$) a hub defining said first axis, $x_2$) said primary part carried by the hub to be adjustable relative to the hub whereby the preferred positioning of the drum support may be initially established.

10. The combination of claim 6 including a drum on the support.

11. The combination of claim 1 wherein the stand includes an upright component, and multiple legs having hinge connections to the stand.

12. The combination of claim 4 wherein the carrier defines a swivel operable to allow the shaft to swing into a position generally parallel to the stand for transport.

13. The combination of claim 4 including an adjustable holder on the carrier carrying said primary part, and adjustably rotatable about said first axis.

14. The combination of claim 13 including a tightener on the carrier to fix said holder in selected position about the first axis.

15. The combination of claim 4 including an adjustable clamp on the shaft, carrying said secondary part, the clamp adjustable lengthwise of and relative to the shaft.

* * * * *